US008382113B2

(12) United States Patent
Costa

(10) Patent No.: US 8,382,113 B2
(45) Date of Patent: Feb. 26, 2013

(54) CARD GAME

(75) Inventor: Peter Costa, Narborough (GB)

(73) Assignee: Two Black Nines, LLC, Las Vegas, NV (US)

( * ) Notice: Subject to any disclaimer, the term of this patent is extended or adjusted under 35 U.S.C. 154(b) by 31 days.

(21) Appl. No.: 13/184,400

(22) Filed: Jul. 15, 2011

(65) Prior Publication Data

US 2012/0181750 A1 Jul. 19, 2012

Related U.S. Application Data

(60) Provisional application No. 61/364,697, filed on Jul. 15, 2010.

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | | |
|---|---|---|---|---|
| 5,713,574 | A | 2/1998 | Hughes | |
| 5,873,571 | A | 2/1999 | Vaisman et al. | |
| 6,012,719 | A | 1/2000 | Webb | |
| 6,056,641 | A | 5/2000 | Webb | |
| 6,237,916 | B1 | 5/2001 | Webb | |
| 6,311,978 | B1 | 11/2001 | Moody | |
| 6,345,823 | B1 | 2/2002 | Webb | |
| 6,371,867 | B1 | 4/2002 | Webb | |
| 6,409,174 | B1 | 6/2002 | Demarest | |
| 6,481,719 | B2 | 11/2002 | Webb | |
| 6,523,831 | B2 | 2/2003 | Webb | |
| 6,609,711 | B1 | 8/2003 | Campbell | |
| 6,698,759 | B2 | 3/2004 | Webb et al. | |
| 7,108,265 | B1 | 9/2006 | Dargue | |
| 7,137,630 | B2 * | 11/2006 | Yurkins | 273/292 |
| 7,175,180 | B2 * | 2/2007 | Webb | 273/292 |
| 7,175,522 | B2 | 2/2007 | Hartl | |
| 7,416,187 | B2 | 8/2008 | Forster | |
| 2001/0040344 | A1 | 11/2001 | Zahedi | |
| 2002/0195775 | A1 | 12/2002 | Webb et al. | |
| 2006/0255540 | A1 | 11/2006 | O'Hagan | |
| 2006/0267285 | A1 | 11/2006 | Webb et al. | |
| 2007/0210520 | A1 | 9/2007 | Webb | |
| 2007/0228653 | A1 | 10/2007 | Lambert et al. | |
| 2007/0241506 | A1 | 10/2007 | Kling et al. | |
| 2008/0139268 | A1 | 6/2008 | Zora | |
| 2009/0085296 | A1 | 4/2009 | Webb | |

OTHER PUBLICATIONS

Pojack Gaming, "How to Play," Jun. 8, 2009; 31 pages.

* cited by examiner

*Primary Examiner* — Michael Dennis
(74) *Attorney, Agent, or Firm* — Adams Monahan, LLP; J. R. Maddox

(57) ABSTRACT

A card game in which players compete against a dealer to obtain a poker hand and a blackjack hand that beats the dealer without busting by exceeding 21 points.

4 Claims, 3 Drawing Sheets

CARD GAME

RELATED APPLICATIONS

This application relates to U.S. Patent Application Ser. No. 61/364,697 filed on Jul. 15, 2010, titled Card Game, and to U.S. Patent Application Ser. No. 61/249,849 filed on Oct. 8, 2009, titled POKER BUST, and to U.S. Patent Application Ser. No. 61/157,519 filed on Mar. 4, 2009, titled POKER BUST, and to U.S. patent application Ser. No. 12/717,819 filed on Mar. 4, 2010, titled Card Games which are hereby incorporated by reference in their entireties.

BACKGROUND

Card games often utilize a deck including 52 cards. These cards are often made of a heavy glossy paper or plastic material. The front surfaces of the cards include printed indicia thereon that distinguish the cards from each other. The rear surfaces of the cards may be blank or can include a decorative design or pattern. The rear surface is typically the same on all cards so that one card can not be distinguished from another card by viewing the rear surface. Various games can be played using this standard deck of cards.

SUMMARY

In general terms, this disclosure is directed to a card game. In one possible configuration and by non-limiting example, players compete against a dealer to obtain a poker hand and a blackjack hand that beat the dealer without busting by exceeding 21 points.

One aspect is a method of playing a card game with players and a dealer, the method comprising: obtaining two wagers from each player, the wagers being of equal value and including a first wager and a second wager; dealing to each player and the dealer, in turn, five cards; obtaining a decision from each player as to which three cards to keep and which two cards to discard; and determining whether a player has won by comparing the player's cards with the dealer's cards and determining if the player's cards beat the dealer's cards according to both a highest poker hand and also according to a blackjack hand.

DETAILED DESCRIPTION

Various embodiments will be described in detail with reference to the drawings. Reference to various embodiments does not limit the scope of the claims attached hereto. Additionally, any examples set forth in this specification are not intended to be limiting and merely set forth some of the many possible embodiments for the appended claims.

Figure 1:
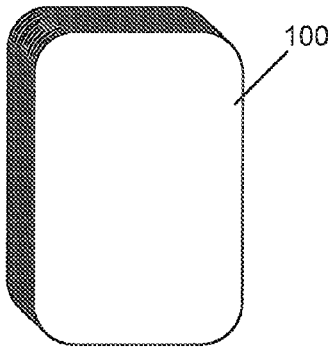
FIG. 1 is a schematic block diagram of an example deck of playing cards.
Figure 2:
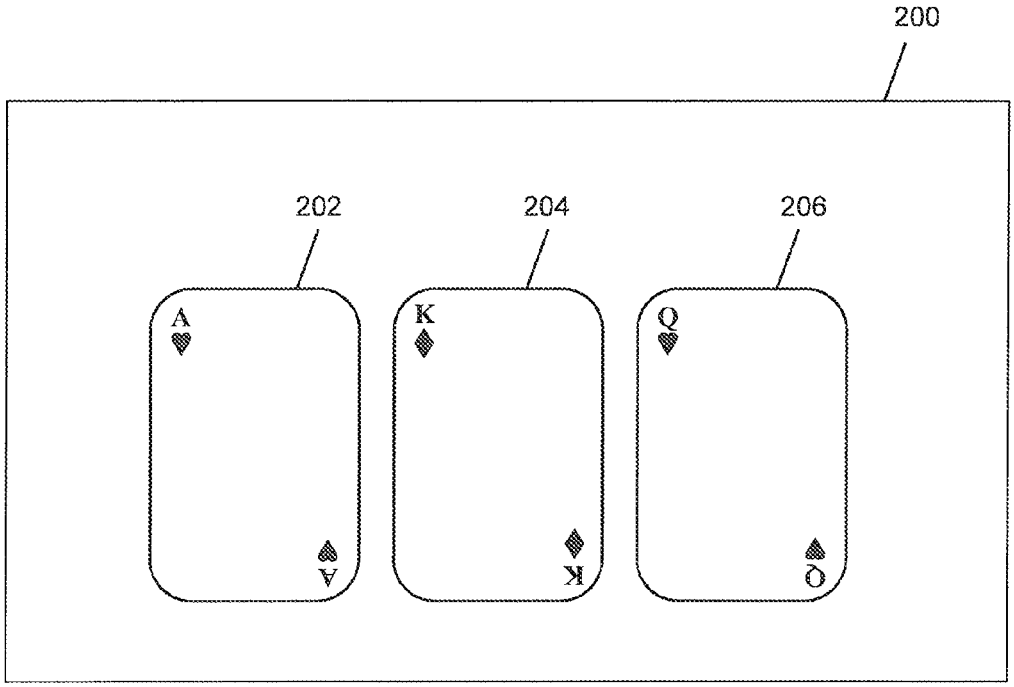
FIG. 2 is a schematic block diagram of several playing cards arranged on a table during play.
Figure 3:
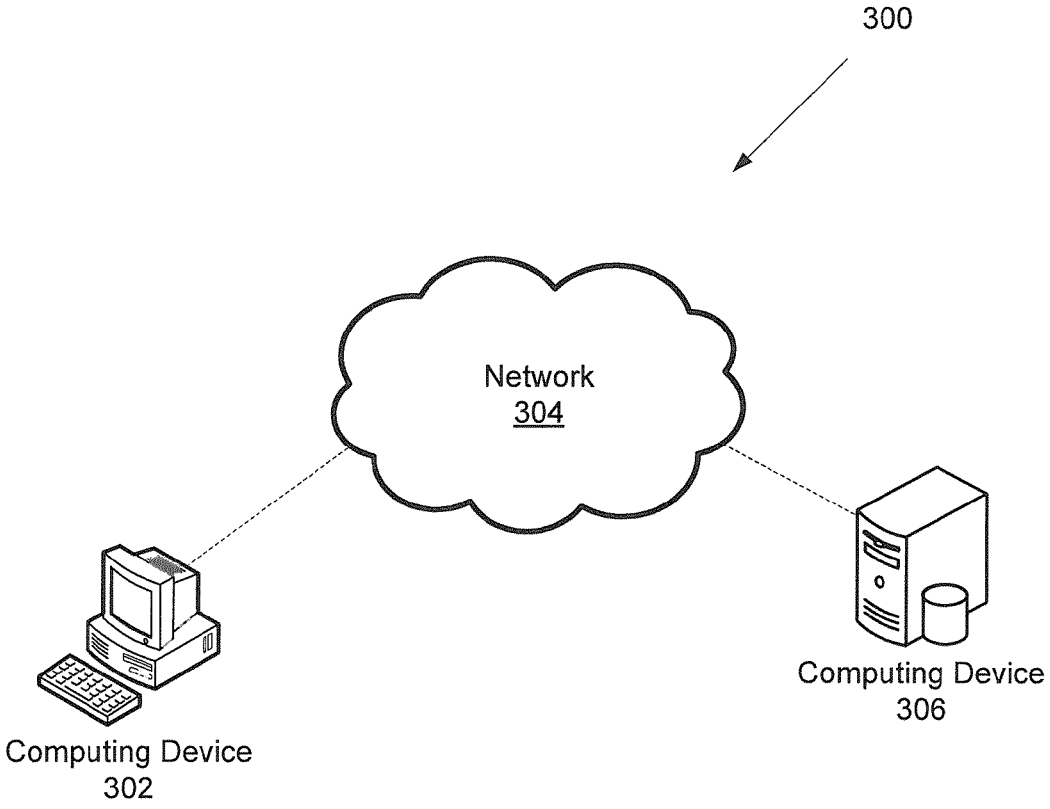
FIG. 3 is a schematic block diagram of an example computing system.

As described further below, the card games can be played using one or more standard 52-card decks of cards (such as shown in FIG. 1). Some embodiments are played on or around a playing surface like a table (such as shown in FIG. 2). In other examples, the card games can be played on one or more computing devices (such as shown in FIG. 3) located at establishments or in an online environment over a network such as the Internet. In some examples, when card games are played on computing devices, the computing devices generate visual representations of physical playing cards that are, for example, displayed on a display device, such as a computer monitor.

Version One

Some embodiments of the card game bring together the two popular games of blackjack and poker. The game is played by using a standard 52-card deck. The point value for each is as face value, with all picture cards counting ten points and the Ace counting one or eleven.

The object of the game is to better both the blackjack points score and poker hand of the dealer, without the player's cards totaling more than 21. As for the poker wager, the three best cards will be used to form a poker hand to determine winners.

Casino Version Rules

In an example embodiment of a card game, players make two wagers of equal value: one for a blackjack hand and the other for a poker hand. Players then compete against the dealer for both hands. The object of the card game is to use three cards (from a total of five cards) to create a total points value as close to 21 as possible without going over 21. All face cards (Kings, Queens and Jacks) are valued at 10 points. Aces are worth 1 or 11, whichever is preferable. All other card values are represented by their number. Of the five cards dealt to a player, the player discards two cards and keeps three cards. The three cards chosen (kept) by the player are used to determine a) the player's poker hand and b) the player's blackjack hand. A blackjack in this game will consist of one Ace (value of 1) and two other cards with a face value of 10 points, or one Ace (value of 11) and one other card with a value of 10 points.

Figure 4:
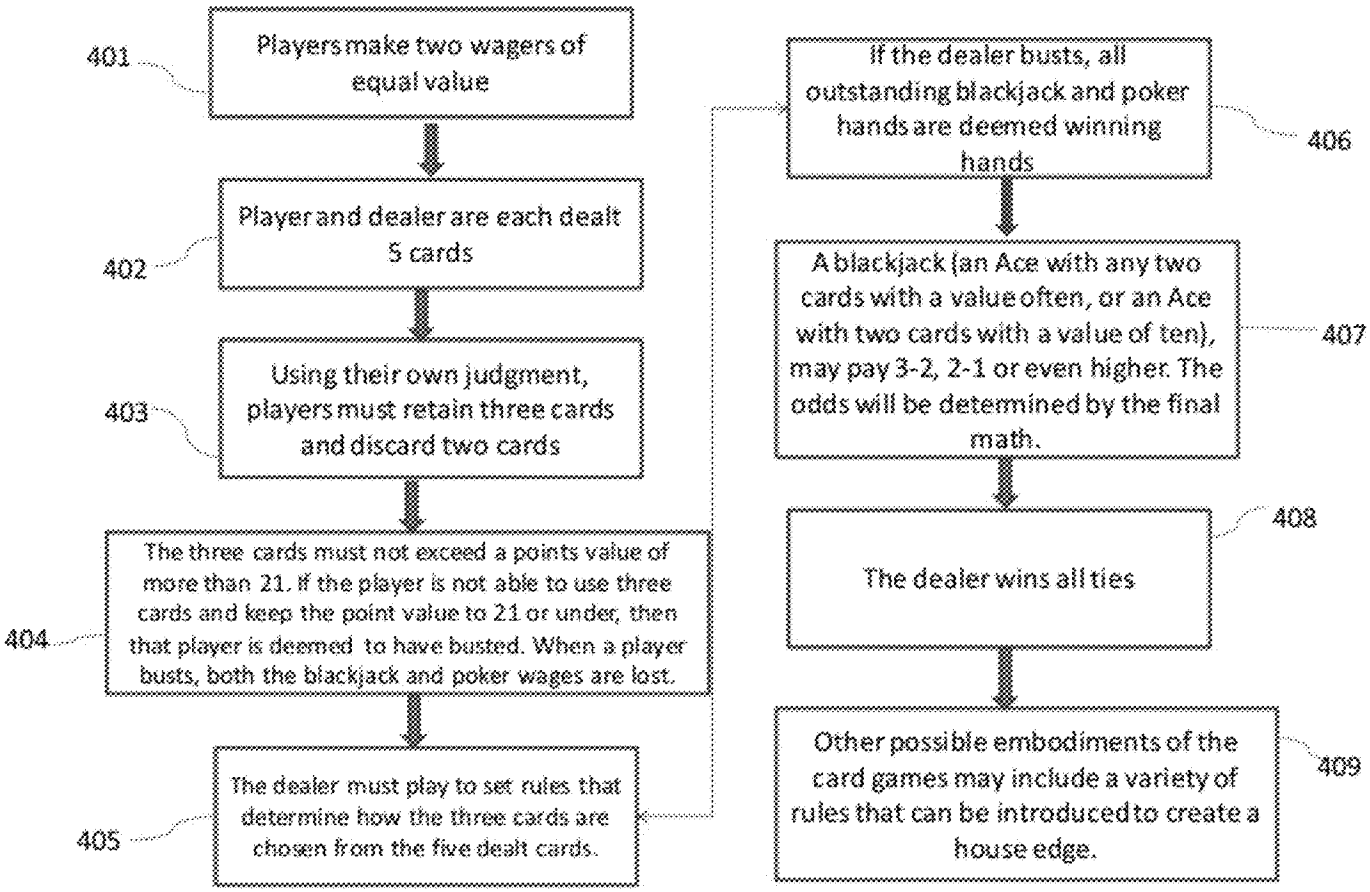
FIG. 4 is a flow chart of the game method according to an embodiment of the present invention.

FIG. 4 is a flow chart illustrating a method of game play according to an embodiment of the present invention wherein:

1. Player makes two wagers of equal value, as in step 401.
2. Player and dealer are each dealt 5 cards, as in step 402.
3. Using their own judgment, players must retain three cards and discard two cards, as in step 403.
4. The three cards must not exceed a point value of more than 21. If the player is not able to use three cards and keep the point value to 21 or under, then that player is deemed to have busted. When a player busts, both the blackjack and poker wagers are lost, as in step 404.
5. Referring to step 405, the dealer must play to set rules that determine how the three cards are chosen from the five dealt cards. Unlike the player, who has the option as to which three cards are chosen, the dealer must choose the three cards that form the highest possible score closest to 21. In rare instances however, the dealer will have more than one choice. In such cases, the dealer must use the three cards that optimize the dealer's poker hand, but only if it does not alter the dealer's blackjack points value.
6. If the dealer busts, all outstanding blackjack and poker hands are deemed winning hands, as in step 406.
7. A blackjack (an Ace with any two cards with a value of ten, or an Ace with two cards with a value of ten), may pay 3-2, 2-1 or even higher, as in step 407.
8. The dealer will win all ties, as in step 408.

9. Other possible embodiments of the card games may include a variety of rules that can be introduced to create a house edge. For example: a dealer will tie any poker hand when the dealer only manages to score a points total of 13, 14 or even higher. This may include one or more points totals. For example, a dealer will tie all blackjack hands when scoring 13 or 14 points. Another embodiment allows the dealer to create the best poker hand if the dealer is not able to score a minimum of 17 points for the blackjack hand.

Some embodiments include one or more of the following optional wagers.

"Bust insurance:" In some embodiments, players may place a wager before the cards are dealt for insurance against the possibility of going bust.

"Win Both Wagers:" In some embodiments, player may place a wager before any cards are dealt on the possibility of winning both the blackjack and poker wagers. The odds on this will vary between 5-2 and 3-1.

"Bonus payouts:" Another optional wager of some embodiments can pay a variety of odds for a five-card poker hand. For example, one pair, two pair, three-of-a-kind, five-card straight, five-card flush, four-of-a-kind, and a royal flush. For extra excitement and fun, one or more jackpots could be offered. A jackpot would be won, for example, by any player having a royal flush made of the three chosen (kept) cards. Example: Ace of diamonds, King of diamonds, and Queen of diamonds. Others hands could be used to determined the winner of a jackpot.

"Pair Plus:" In some embodiments, a player may wager that they will be dealt a hand with a particular outcome before any cards are dealt, such as one pair, or some other valuable configuration.

Player must make two wagers of equal value, one for the blackjack part of the game, the other for the poker game. However, it may well be viable to allow these bets to be of different amounts.

Also, it is possible in all versions the card games disclosed herein that continuation bets and side bets be allowed throughout the game.

Video/Slot Machine Version

The video machine version would apply the same rules as the casino version. The only difference is that it may be one player versus the dealer, or possibly multiplayer, depending on the available technology. Several additions could apply, but in general it will be presented similar to the blackjack that is currently on offer.

Online Casino Version

The same rules would apply for any online casino version, whether it be a single-player game, or a multi-player game.

Online Player vs. Player Version

This version is played in a limit format or even in a no limit format.

A button (as in poker) is used to dictate the order in which players act.

FIG. 1 is a schematic block diagram of a deck of playing cards 100. A standard 52-card deck of playing cards 100 is used in some embodiments. FIG. 2 shows some of cards 100 (202, 204, 206 and 208) arranged on a table.

In some embodiments, playing cards 100 are made of paper, such as a heavy paper, thin card, or thin plastic. Playing cards 100 typically include a face surface and a back surface. The face surface typically includes markings thereon that distinguish the cards from other cards in the deck. The markings are also used to determine the permissible uses of each card according to the rules of the game being played, such as discussed in more detail herein. Examples of markings include printed indicia that identify the card as being one of an Ace, 2, 3, 4, 5, 6, 7, 8, 9, 10, Jack, Queen, and King, and also identify the card as being of a suit selected from diamonds, clubs, hearts, and spades, in some embodiments.

FIG. 3 is a schematic block diagram of an example computing system 300. The example computing system 300 includes at least one computing device 302. In some embodiments the computing system 300 further includes a communication network 304 and one or more additional computing devices 306 (such as a server).

Computing device 302 can be, for example, located in a gaming establishment or can be a computing device located in a user's home. Computing device 302 can be a stand-alone computing device 302 or a networked computing device that communicates with one or more other computing devices 306 across network 304. Computing device 306 can be, for example, located remote from computing device 302, but configured for data communication with computing device 302 across network 304.

In some examples, the computing devices 302 and 306 include at least one processor or processing unit and system memory. Depending on the exact configuration and type of computing device, the system memory may be volatile (such as RAM), nonvolatile (such as ROM, flash memory, etc.) or some combination of the two. System memory typically includes an operating system suitable for controlling the operation of the computing device, such as the WINDOWS® operating systems from Microsoft Corporation of Redmond, Wash., or a server, such as Windows SharePoint Server, also from Microsoft Corporation. The system memory may also include one or more software applications and may include program data.

The computing device may have additional features or functionality. For example, the device may also include additional data storage devices (removable and/or non-removable) such as, for example, magnetic disks, optical disks, or tape. Computer storage media may include volatile and non-volatile, removable and non-removable media implemented in any method or technology for storage of information, such as computer readable instructions, data structures, program modules, or other data. System memory, removable storage and non-removable storage are all examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by the computing device. An example of computer storage media is non-transitory media.

In some examples, one or more of the computing devices 302, 306 can be located in an establishment, such as a casino or bar. In other examples, the computing device can be a personal computing device that is networked to allow the user to play card games disclosed herein at a remote location, such as in a player's home or other location. In some embodiments, computing device 302 is a smart phone or other mobile device. In some embodiments the rules of game play are stored as data instructions for a Smartphone application. A network 304 facilitates communication between the computing device 302 and one or more servers, such as computing device 306, that host the card games. The network 304 may be a wide variety of different types of electronic communication networks. For example, the network may be a wide-area network, such as the Internet, a local-area network, a metropolitan-area network, or another type of electronic communication network. The network may include wired and/or wireless data links. A variety of communications protocols may be used in the network 108 including, but not limited to, Ethernet, Transport Control Protocol (TCP), Internet Protocol (IP), Hypertext Transfer Protocol (HTTP), SOAP, remote procedure call protocols, and/or other types of communications protocols.

In some examples, computing device 306 is a Web server. In this example, computing device 302 includes a Web browser that communicates with the Web server to request and retrieve data. The data is then displayed to the user, such as using a Web browser software application. In some embodiments, the various operations, methods, and rules disclosed herein are implemented by instructions stored in memory. When the instructions are executed by the processor of one or more of computing devices 302 and 306, the instructions cause the processor to perform one or more of the operations or methods disclosed herein. Examples of operations include the operations of game play and enforcement of one or more rules of the game.

In one embodiment, the card game may be played with players and a dealer using the computing system 300. As described above, the computing system 300 includes at least one server, such as the one or more servers 306 to host the card game and the at least one computing device 302 communicably coupled to the one or more servers 306 through the communication network 304. Accordingly, the card game may be played by obtaining wagers from each player through the at least one computing device 302. The wagers may be of equal value and include a first wager and a second wager. Thereafter, five cards may be dealt to the each player and the dealer through the one or more servers 306, wherein each of the cards dealt to a player is dealt face up.

Subsequently, a decision from the each player through the at least one computing device 302 may be obtained as to which three cards to keep and which two cards to discard, which actions may be performed through the one or more servers 306.

As described above, the cards dealt to the each player and are visual representations of physical playing cards, the visual representations being generated by the at least one computing device 302. Also, dealing to each player and the dealer, in turn, five cards includes displaying the visual representations of the physical playing cards on a display device (not shown) of the at least one computing device 302.

Further, a total score of the player's cards may be determined through the one or more servers 306 for establishing the formation of a blackjack hand for the each player. As described above, the blackjack hand is a 21-point blackjack hand formed when the total score is up to a maximum of 21 points. Thereafter, it may be determined whether a player has won by comparing the player's cards with the dealer's cards through the one or more servers 306 based on the total score, and if the players cards beat the dealer's cards according to both a highest poker hand and also according to the 21-poker blackjack hand, through the one or more servers 306.

As mentioned above, each of the at least one computing device 302 and the one or more servers 306 includes a processor (not shown) and a memory (not shown), and wherein at least one of the respective memories stores instructions, which executed by the respective processor, cause the respective processor to perform one or more operations of obtaining wagers, dealing, obtaining a decision, and determining whether a player has won.

The each of the at least one computing device 302 may be one of a mobile device and a computer communicably coupled with the one or more servers 306 for data communication. Further, the each of the at least one computing device 302 is located at one of a gaming establishment and a remote location.

The various embodiments described above are provided by way of illustration only and should not be construed to limit the claims attached hereto. Those skilled in the art will readily recognize various modifications and changes that may be made without following the example embodiments and applications illustrated and described herein and without departing from the true spirit and scope of the following claims.

What is claimed is:

1. A method of playing a card game with players and a dealer in a computing system comprising at least one server to host the card game and at least one computing device communicably coupled to the at least one server through a communication network, the method comprising:

obtaining wagers from each player through at least one computing device, the wagers being of equal value and including a first wager and a second wager;

dealing to each player and the dealer, in turn, five cards through at least one server;

obtaining two discarded cards from each player through a computing device, such that each player maintains three cards; and determining whether a player has won through at least one server by comparing the player's cards with the dealer's cards according to both a highest poker hand and also according to a 21-point blackjack hand, wherein a player is deemed to have lost if a sum of the points value of the player's three cards is greater than 21.

2. The method of claim 1, wherein at least one computing device is one of a mobile device and a computer communicably coupled with the at least one server for data communication.

3. The method of claim 2, wherein at least one computing device is located at one of a gaming establishment and a remote location.

4. The method of claim 1, wherein players have the option of making additional wagers beyond the first wager and the second wager.

* * * * *